US005165581A

United States Patent [19]

Uhl

[11] Patent Number: 5,165,581

[45] Date of Patent: Nov. 24, 1992

[54] BOTTLE AND COVER POSITIONABLE TO ENABLE REMOVAL OF CONTENTS THEREFROM

[76] Inventor: Michael Uhl, 829 Myrna Dr., West Hempstead, N.Y. 11552

[21] Appl. No.: 635,275

[22] Filed: Dec. 28, 1990

[51] Int. Cl.[5] ..... B67D 3/00

[52] U.S. Cl. ..... 222/480; 220/307; 222/416; 222/481.5; 222/545; 222/548; 222/565; 222/570

[58] Field of Search ..... 222/189, 330, 331, 416, 222/464, 480, 481, 481.5, 545, 565, 567, 569, 570, 548, 557; 220/307, 367

[56] References Cited

U.S. PATENT DOCUMENTS

| | | | |
|---|---|---|---|
| 3,104,039 | 9/1963 | Dike | 222/545 X |
| 3,501,067 | 3/1970 | Rigor | 222/464 |
| 3,968,907 | 7/1976 | Nix, nee Saxler | 222/416 |
| 4,284,200 | 8/1981 | Bush et al. | 222/545 X |
| 4,747,511 | 5/1988 | Dutt et al. | 220/307 |
| 4,993,584 | 2/1991 | Macario | 222/480 X |
| 5,018,635 | 5/1991 | Whittaker | 220/90.4 X |

FOREIGN PATENT DOCUMENTS

| | | | |
|---|---|---|---|
| 708052 | 4/1965 | Canada | 222/480 |
| 2038294 | 7/1980 | United Kingdom | 222/545 |

*Primary Examiner*—Kevin P. Shaver
*Assistant Examiner*—Joseph A. Kaufman
*Attorney, Agent, or Firm*—Bauer & Schaffer

[57] ABSTRACT

A cylindrical body having a countersunk wall defining a trough around the internal periphery thereof, a removable cover assembly comprising a circular bottom member and a pair of semicircular plates disposed over the bottom member. The plates are supported and rotatable in a groove extending around the internal wall of the body member and are provided with a spring for urging the plates apart. A syphon tube forming an integral part of the bottle extends internally from the bottom of the trough to the cover.

20 Claims, 3 Drawing Sheets

BOTTLE AND COVER POSITIONABLE TO ENABLE REMOVAL OF CONTENTS THEREFROM

This invention relates to a bottle and more particularly, to an improved water bottle for use by racers, particularly bicycle racers and marathoners.

BACKGROUND OF THE INVENTION

In many sports activities, such as long distance bicycle racing, marathon running and the like, the participant is easily prone to exhaustion and other physical ailments due to rapid dehydration. As a consequence, racers have taken to carrying water bottles on their bikes or on their person from which to imbibe as the need occurs. The term water bottle encompasses not only water, but juices, nutrient mixtures and other liquids which racers and the like consume.

Such bottles are generally provide with caps that are easily openable, and with straws or syphon devices through which the user may obtain the liquid. The use of such rather complex arrangements is to maintain integrity of the bottle, thereby avoiding contamination of the contents and premature spillage.

While bottles of this type generally accomplish their intended purpose in a satisfactory manner, there still exists a need for further improved bottles of this type which are even more secure particularly during race conditions or carried with dry goods, papers, clothing, food, etc.

The foregoing, as well as other objects, will be readily apparent from the following disclosure.

BRIEF STATEMENT OF THE INVENTION

In accordance with the invention, there is provided a bottle which comprises a generally elongated, cylindrical body member having a countersunk end wall closing one end defining a trough around the internal periphery thereof. A cover assembly closes the body member at the end opposite the end wall. The cover assembly includes top and bottom circular members, a pair of semi-circular segment plates slidingly disposed between the top and bottom member in spaced relationship with respect to each other. The semi-circular peripheral edges of the segment plates are supported and rotatable in a groove extending around the internal wall of the body and are urged apart by spring means located between the segment plates. A syphon tube forming an integral part of the body member extends internally downward into the trough of the body. A uni-directional air valve allowing entry of atmospheric air into the body, but preventing spillage of liquid outwardly is also provided in the bottom member of the cover. Mounted above the bottom cover member and extending through the upper cover member is a rotatable disk provided with a sucking tube and a mist screen outlet. The disk is rotatable between a closed position in which the syphon tube with a vent opening is blocked and an open positione presenting either the sucking tube or mist outlet in line with the syphon tube.

Thus, drinking from the bottle or misting oneself with water may be easily made by simply rotating the disk to align the sucking tube or misting outlet with the syphon tube. On the other hand, the bottle is closed by rotating the disk so that the sucking tube and misting outlet are out of alignment with the syphon tube. The bottle may be drained and/or filled by removing the cover assembly, simply by squeezing the segment plates toward each other to disengage them from the groove and lift the entire cover assembly out of the cylindrical body.

Full details of the present invention are set forth in the following description and are illustrated in detail in the accompanying drawings.

IN THE DRAWINGS

DESCRIPTION OF THE PREFERRED EMBODIMENTS

Figure 1:
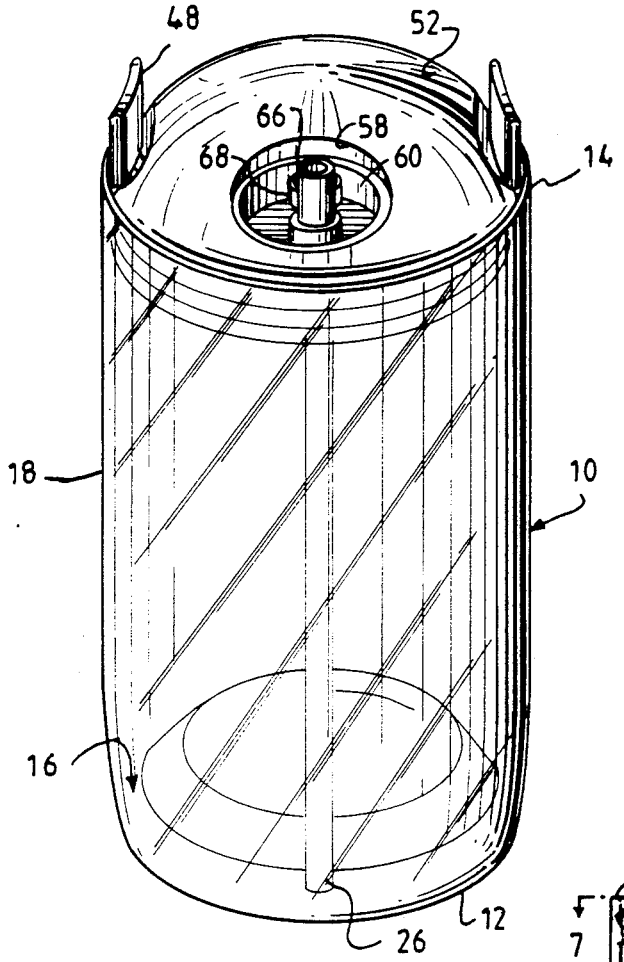
FIG. 1 is a view in perspective of a bottle embodying the invention.
Figure 2:
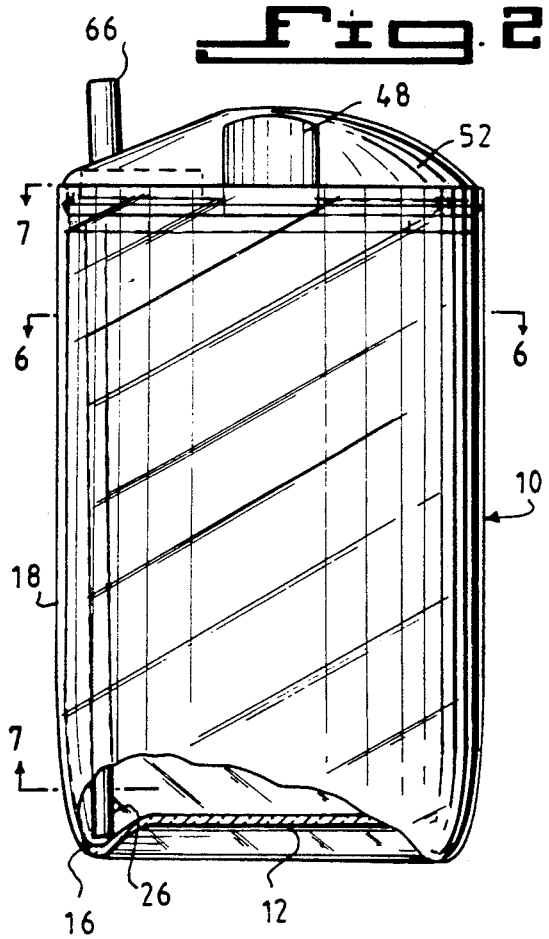
FIG. 2 is an elevational view, partially in section of the bottle shown in FIG. 1 and provided with a domed enclosure.
Figure 3:
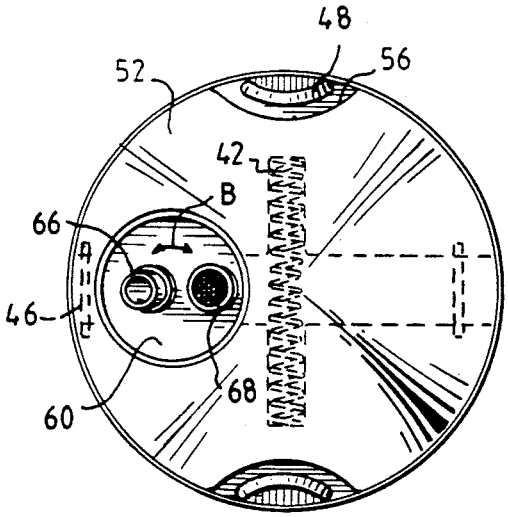
FIG. 3 is a top plan view of the cover illustrated in FIG. 1.
Figure 4:
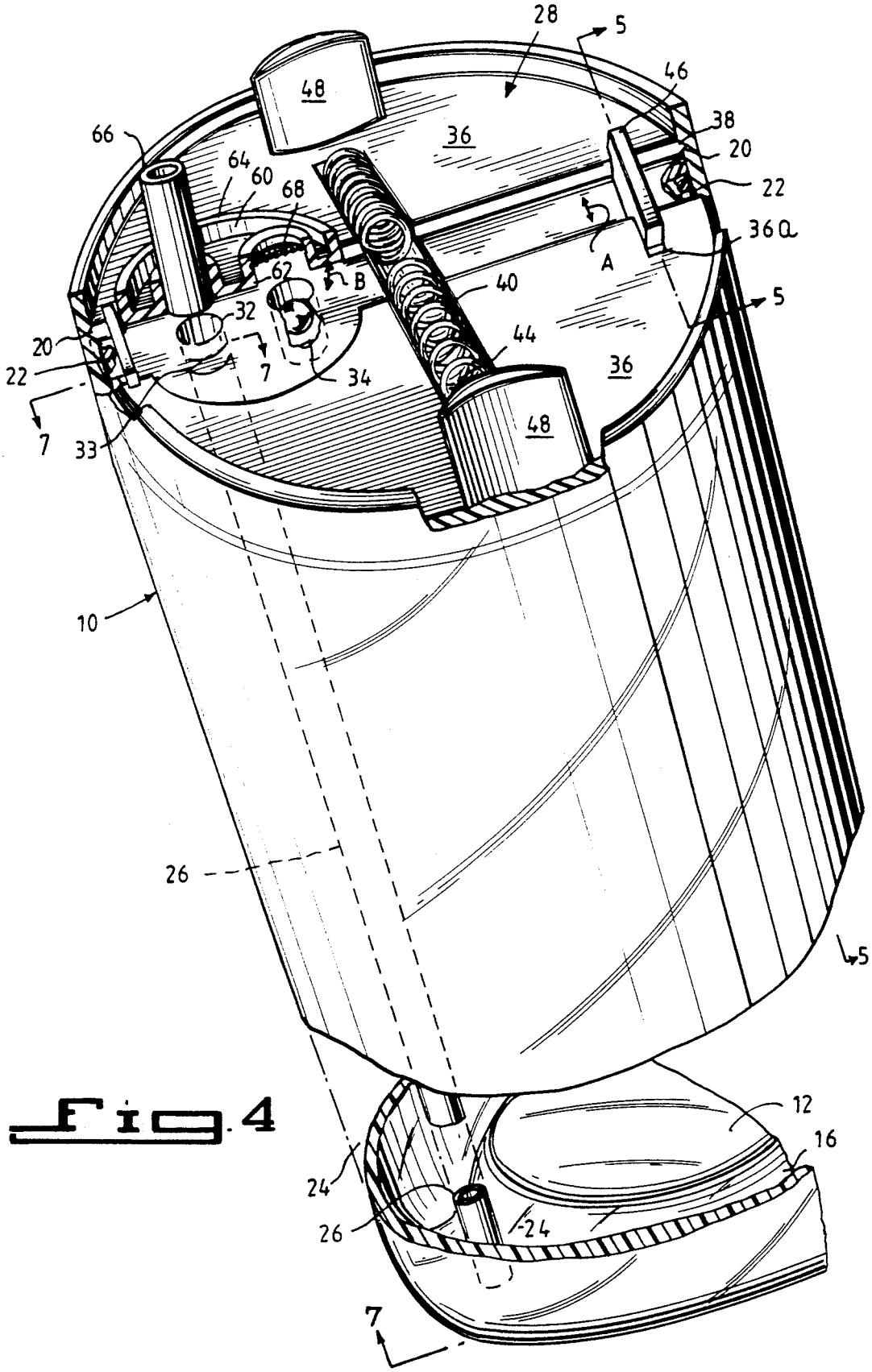
FIG. 4 is a partial, lateral, sectioned diagrammatic view illustrating the cooperative relationship of the bottle elements.
Figure 5:
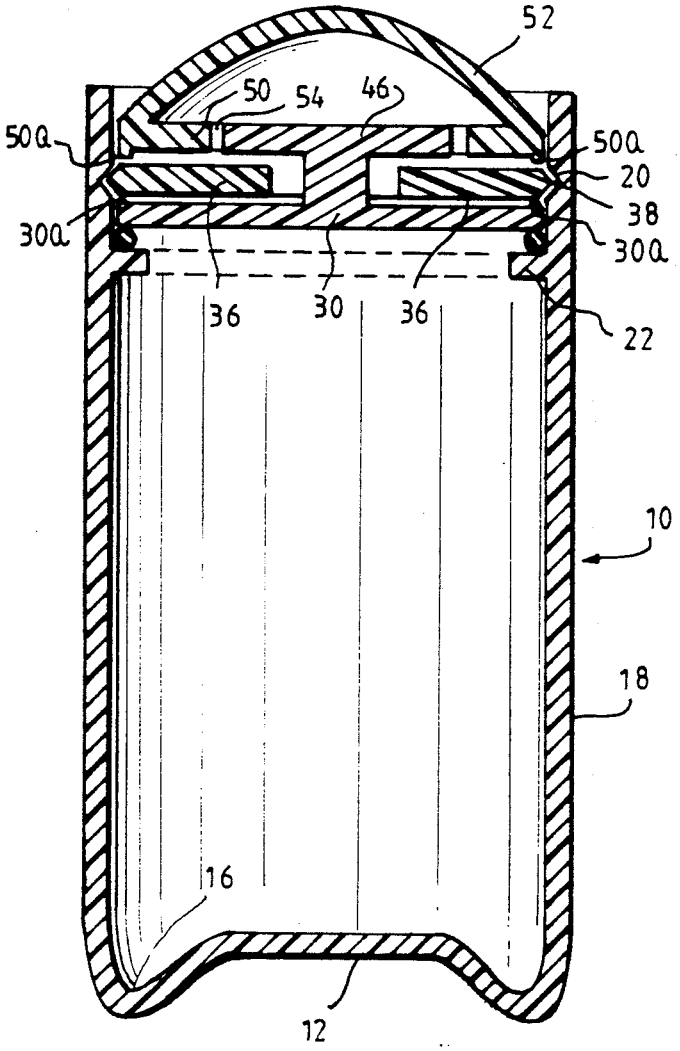
FIG. 5 is a sectional view taken along line 5—5 of FIG. 4.

Referring now to FIG. 1, the bottle according to the present invention, comprises a generally elongated cylindrical body 10 closed at one end 12 and open at its opposite end 14. The closed end 12 is formed with a countersunk wall sloping downwardly around its peripheral edge to form a trough 16.

Figure 6:
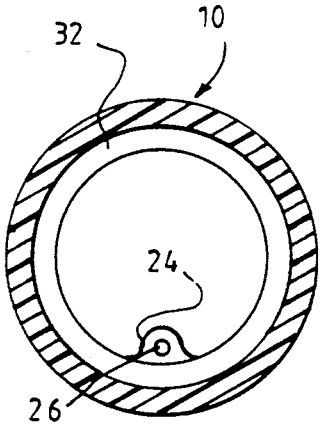
FIG. 6 is a sectional view in diametric plane in the direction of line 6—6 of FIG. 2.
Figure 7:
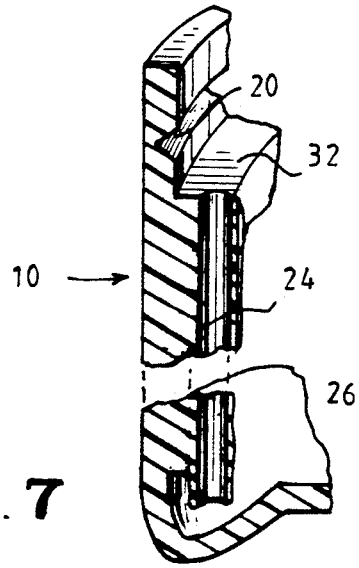
FIG. 7 is a reduced partial cross sectional view of the bottle taken along line 7—7 of FIG. 4.

The inner surface 18 of the bottle is molded (see FIGS. 4, 2, 5 and 7) to provide a peripheral groove 20 just below the open end 14 and an annular flange-like shelf or ledge 22 just below the groove 20. An elongated boss 24 (FIG. 6) extends integrally with the inner surface 18 from the shelf 22 to a point within the trough 16 of the closed end wall. The boss 24 is formed with an interior bore forming a syphoning tube 26 from one end of the bottle to the other.

The bottle is provided with a removable closure assembly generally shown by numeral 28. The closure assembly 28 comprises a circular bottom disk 30 having an outside diameter equal to the inside diameter of the bottle 10 at its open end 14 so that it can rest on the shelf 22 and fit snugly within the bottle. Radially inward from the edge of the bottom disk is a through hole 32 provided with a lip 33 arranged so that the hole 32 can be accurately aligned with the syphoning tube 26. Located inwardly of and radially in line with the hole 32, is a uni-directional, ball-type valve 34 adapted to allow air into the bottle but prevent liquid from escaping.

Slidably resting on the upper surface of the bottom disk 30 are a pair of congruent semi-circular segment plates 36, the outer peripheral edges of which are pointed to provide an arrow shaped edge 38 which fits into the annular groove 20 provided in the inner wall of the bottle. The segment plates 36 are urged apart by a compression spring 40 set in facing a diameter slot 42 formed in each segment plate. To hold the compression spring in place, the segment plates 36 may be provided with a centrally extending tongue 44 passing through the slots 42 into the center of the spring 40. Other means for forming the spring biasing means or for holding the spring 40 may also be devised. To prevent the segment plates 36 from buckling, a pair of T-shaped brackets 46 are provided. The stems of the T-shaped brackets are integral with top surface of the bottom disk 30 so that the lateral arms pass into small slots 36*a* found in the segments 36 to guide the segments as they slide. In this manner, the segment plates 36 may be moved toward each other (arrows A) releasing the peripheral arrow shaped edges 38 from their seat in the groove 20. To facilitate squeezing the segment plates 36, each is provided with an upstanding finger tab 48.

The closure assembly 28 is completed by providing a top circular disk 50 integral with a spherical shaped dome 52. The top disk 50 is provided with a pair of spaced slots 54 which fit over the T-shaped brackets 48, and a pair of oppositely located semi-circular cut-outs 56 arranged to fit about the finger grips 48. Lastly, a vertical cylindrical section 58 is integrally formed to pass through the dome 52 and the top disk 50 in direct alignment with the syphoning tube 26 and the valve 34. Thus, the top disk and dome can be accurately placed in this alignment since the slots 54 and the cut-outs 56 establish a fixed relationship between the closure assembly and the bottom disk 30. In addition, the top disk 50 rests on the compression spring 40, which urge the finger grips apart and therefore, acts to keep the spring 40 in place..

To retard and maintain the movable plates 36 between the top and bottom disks (30 and 50, respectively), when the top is removed from the body of the bottle, each of the disks are provided with a peripheral head or lip 30*a* and 50*a* on the opposing and contacting surfaces with the plates 30 respectively. The heads are held in opposition so that a narrow annular space between the lips 30*a* and 50*a* are formed allowing the arrow shaped edges 38 to protrude only so far as to be able to seat within the groove 20, but not so far as to slide out from between the top and bottom disks. It is also possible to position the finger grip 48 at a distance inwardly of the peripheral edge of the top disk 50 so that the top disk would hold the plates from sliding outwardly.

Set within the vertical cylindrical section 58 is a carousel 60 rotatable in either direction (see Arrow B). The carousel has a flat base 62 and a vertical upward peripheral wall 64 sealed with respect to the disk 30 against fluid flow. The flat base 62 is adapted to lie on the bottom disk 30 of the closure assembly to normally occlude syphon outlet 32 and the valve 34. The flat base 62 is provided with two holes in one of which is wedged in fixed arrangement, a sucking tube 66, and in the other is fit a small pore screen 68 designed to turn a stream of water into a mist. The two holes in base 62 are arranged so that when either one of the sucking tube or screen is located in axial alignment with syphoning outlet 32, the other is in axial alignment with the valve 34. Otherwise, both the syphoning tube and the valve are occluded and no liquid can be withdrawn or squeezed out of the bottle nor air allowed in. Preferably, the syphon hole 32 and valve 34 and the sucking tube 66 and screen 68 in the carousel are aligned respectively along a diameter of the bottle so that rotation between an inoperative and operative position is easily made. In addition, the external surface of the bottle can be provided with indicia visual and/or tactile to indicate the correct operative position of the carousel. The sucking tube 66 preferably is long enough to extend above the surface of the dome 52 so that the user can easily apply his mouth to it. The entire cover assembly is easily removed by squeezing the finger grips together releasing the segment 36 from engagement with the groove 38 carrying with it, the bottom disk 30 and the top disk 50 with the dome 52. Refilling and cleaning of the bottle is thus quite easy.

The various, movable and slidable parts are provided with suitable liquid seals such as O-rings, washers and the like to make the bottle extremely safe during use.

The bottle and the parts thereof, are preferably made of strong, lightweight plastic, such as polyethylene, polyurethane, polyamide or polyester plastic which is readily available and inexpensive. On the other hand, it may also be made of metal such as lightweight steel, aluminum or tin. In this connection, the body may be made of metal and the cover of plastic, or the body of plastic and the cover of metal or any combination of plastic and metal.

The bottle may also be made in any of a wide variety of sizes and the interior surface of this bottle may be coated with a suitable coating material such as that known in the art to avoid any ill effects to the contents. The bottle may be employed to hold any suitable liquids such as coffee, tea, milk, water, juice, soda and the like.

Numerous modifications of the bottle of this invention may be made without departing from the spirit and scope of the invention. It is to be understood, therefore, that this invention is not to be limited to the embodiments described above, except as defined in the appended claims.

What is claimed is:

1. A bottle comprising a cylindrical body having at one end a countersunk wall defining a trough around the internal periphery thereof, and an open end provided with a removable cover assembly having a circular bottom member, a pair of semi-circular plates disposed over said bottom member in spaced relationship with respect to each other, and a circular top member, each of said plates having a semi-circular peripheral edge supported in a groove extending around the internal wall of said body member, means biasing such plates diametrically apart, and means for manually urging said plates toward each other to release said cover assembly, and a syphon tube forming an integral part of said body member wall and extending internally thereof from said bottom member into said trough, and an outlet hole disposed over said bottom member and extending through said top member movable between a first position in alignment with said syphon tube and a second position remote therefrom.

2. The bottle according to claim 1 including a sucking tube is mounted in a rotatable member adapted to normally lie on said bottom member, said rotatable member normally occluding the syphoning tube and being rotatable between said first and second positions to allow communication with said sucking tube.

3. The bottle according to claim 2 including a unidirectional air valve located laterally of said syphoning hole.

4. A bottle according to claim 2, wherein the sucking tube is located on said rotatable member and movable therewith into alignment with the syphon tube which is formed as an integral part of the elongated, circular body member and extends internally thereof from said body member into said trough and the other of the rotatable member is provided with another opening, a ball valve aligned with said another opening for permitting entrance of air to said bottle and prevents loss of liquid therefrom.

5. A bottle according to claim 4, wherein said circular top member is provided with a domed top, said domed top being provided with cut-away portions, tabs on the plates extending through the cut-away portions, and an opening to provide passage for a syphon tube sucking extension and exposure of the valve opening.

6. The bottle according to claim 1, wherein said plates are supported and slideable in a toggle groove extending around the internal wall of said body member and provided with a pair of aligned diameter recesses having a spring located therein which urge said plates away from each other, each of said plates being in alignment with each other and with said spring for urging said plates into closer proximity to each other when pressure is applied inwardly therein.

7. The bottle according to claim 6, wherein the bottom member is provided with upwardly extending T-brackets which limit the movement of the plates toward each other when pressure is applied to the tube and also the top and bottom circular member.

8. The bottle according to claim 7, including means for limiting the outward opposing movement of said plates.

9. A bottle according to claim 8, including a screen inserted over the valve opening to provide a mist when aligned with syphon tube.

10. A bottle according to claim 6, including a peripheral ledge located below said groove, an O-ring located between the bottom disk and said ledge to seal said cover.

11. In a bottle comprising a cylindrical body having an open end, the internal wall of said body having a groove and a ledge formed below the groove extending about the periphery of said bottle, a removable cover assembly comprising a circular bottom member adapted to rest on said ledge, a pair of semi-circular plates disposed over said bottom member in spaced relationship with respect to each other and a circular top member, each of said plates having a semi-circular peripheral edge, means biasing such plates diametrically apart into engagement in said groove, and means for manually urging said plates toward each other to release said cover assembly from said groove and an outlet opening disposed over said bottom member and extending through said top member for removing the contents of said bottle.

12. The removable cover assemby according to claim 11, wherein said bottle is formed with a syphoning tube and an outlet tube mounted in a rotatable member, said rotatable member being adapted to normally lie on said bottom member and occlude the syphoning tube when said outlet tube is not aligned with said outlet opening.

13. The removable cover assembly according to claim 12, including a unidirectional air valve located laterally of syphoning hole on the bottom side of said bottom member.

14. The removable cover assembly according to claim 12, wherein said plates are supported and rotatable in a toggle groove extending around the internal wall of said body member and provided with a pair of aligned diameter recesses having a spring located therein which urge said plates away from each other, each of said plates being in alignment with each other and with said spring for urging said plates into closer proximity to each other when pressure is applied inwardly therein.

15. The removable cover assembly according to claim 14, wherein the top side of said bottom member is provided with upwardly extending T-brackets which limit the movement of said plates toward each other when pressure is applied to said tube and also the said top and said bottom circular member.

16. The removable cover assembly according to claim 15, wherein the top circular member is provided with a domed top, said domed top being provided with cut-away portions to receive the T-brackets and an opening to provide passage of a syphon tube extension and exposure of the valve openings dome thickness also acts as insulator.

17. The removable cover assembly according to claim 14, wherein the outlet tube is located to be brought into and out of alignment with a syphon tube which is formed as an integral part of the elongated, circular body member and extends internally thereof from said body member into said trough and the other of the rotatable member is provided with another opening alignable with a ball valve which permits entrance of air to said bottle and prevents loss of liquid therefrom.

18. A removable cover assembly according to claim 12, including a screen inserted over the valve opening to provide a mist when said valve opening is aligned with said syphon tube.

19. The cover assembly according to claim 11, wherein said top member is rotatable between said first and second positions.

20. A bottle closed at one end and open at the other end, said open end being provided with a removable cover assembly having a circular bottom member, a pair of semicircular plates disposed over said bottom member in spaced relationship with respect to each other, and a circular top member, each of said plates having a semicircular peripheral edge supported in a groove extending around the internal wall of said body member, means biasing such plates diametrically apart, and means for manually urging said plates toward each other to release said cover assembly, and a syphon tube forming an integral part of said body member wall and extending internally thereof from said bottom member into proximity with said closed end, and an outlet hole disposed over said bottom member and extending through said top member movable between a first position in alignment with said syphon tube and a second position remote therefrom.

* * * * *